US006286268B1

(12) United States Patent
Pena

(10) Patent No.: US 6,286,268 B1
(45) Date of Patent: Sep. 11, 2001

(54) SHADE STRUCTURE AND METHODOLOGY HAVING SWIVELING PERIMETER BEAM

(75) Inventor: Felipe Pena, Southlake, TX (US)

(73) Assignee: Sun Ports International, Inc., Dallas, TX (US)

( * ) Notice: Subject to any disclaimer, the term of this patent is extended or adjusted under 35 U.S.C. 154(b) by 0 days.

(21) Appl. No.: 09/616,499

(22) Filed: Jul. 14, 2000

(51) Int. Cl.[7] ..... E04B 1/34

(52) U.S. Cl. ..... 52/73; 52/222; 52/745.06; 160/328; 135/119

(58) Field of Search ..... 52/73, 74, 222, 52/745.06; 135/119, 122, 900, 907; 160/328, 378

(56) References Cited

U.S. PATENT DOCUMENTS 4,887,626 * 12/1989 Dalo et al. ..... 135/119

FOREIGN PATENT DOCUMENTS

WO-9606244-
A1 * 2/1996 (SE) ..... 135/119

* cited by examiner

*Primary Examiner*—Carl D. Friedman
*Assistant Examiner*—Naoko Slack
(74) *Attorney, Agent, or Firm*—Hugh & Luce, LLP

(57) ABSTRACT

A structural system and methodology for erecting a shading structure. The system and methodology provides for a rapid and fool proof installation of the shading element over a canopy structure. The shading element is coupled into a locking mechanism on a perimeter beam which rotates to increase effective the effective surface area of the canopy structure thereby providing the correct amount of tension to the shading element, thereby completing the installation process.

9 Claims, 3 Drawing Sheets

SHADE STRUCTURE AND METHODOLOGY HAVING SWIVELING PERIMETER BEAM

BACKGROUND OF THE INVENTION

1. Technical Field

The present invention relates generally to mechanical structures and associated methodology for providing shade and ultraviolet (UV) protection in various outdoor environments play areas, auto parking, sports fields, theme parks, country clubs and the like.

2. Description of the Related Art

Shade structures are well-known in the art and provide shade—hail, snow, water, heat and UV protection in numerous applications: automobile dealerships, auto parking facilities, water parks, playgrounds, swimming pool areas, tennis courts, outdoor eating areas, amusement parks, and the like. Providing shade has become increasingly significant throughout the United States and abroad because of ever changing and indeterminate weather conditions and the increasing awareness of skin cancer caused by the harmful UV rays from sunlight. Conventional shade structures typically comprise a mechanical support structure made of reinforced steel, and a covering made of high density polyethylene cloth having UV additives. The support structure is designed to handle loading due to wind, snow, hail and other elements in accordance with the local building codes. The structures are often designed in different configurations depending on the desired application. Thus, for example, a dome structure may be used with the roofs on surrounding buildings are curved or there are curved lines present in the design of the building. A hip structure is commonly used to enhance the roofline of surrounding buildings. A pyramid structure is often used when the desired shade area is square.

Another common structure is a cantilever. In this structure as illustrated generally in FIG. 1, each of a set of central support posts 100*a–n* are provided with a pair of outwardly-extending trusses 102*a–b*. Each truss 102 is generally triangular in shape and includes a plurality of cross support beams 104 in a known configuration. The shade 106 extends from an apex 108 outward to an edge 110 of each truss 102. In the prior art, the shade 106 typically includes a cable or rope 112 inside an outside pocket 114. During installation, the shade is positioned over the trusses and pulled taut, and the cable is then secured to an outer perimeter beam 116 in each truss section using a fastener or other mechanical locking means.

With this design, however, it is often difficult to position the shade in an attractive and secure manner along the outer perimeter beam in each truss section. If the shade is not secured properly, it may be damaged during subsequent use and thus compromise the aesthetic appearance and physical integrity of the structure.

The present invention addresses this problem.

BRIEF SUMMARY OF THE INVENTION

It is the object of the present invention to provide a rapid and "fool proof" method for installing the shading element or fabric over the canopy structure.

The perimeter beam connecting each truss section is adapted to swivel or pivot between a first and second position. In the first, installation position, an end of a shading element is loosely positioned within a locking device of the perimeter beam. Thereafter, the beam is rotated outwards and downwards into the second, locking position pulling the shade fabric taut. In this position, the shade fabric extends around an outer periphery of the beam and is locked within the locking structure. This configuration provides secure tensioning of the shade fabric that is aesthetically pleasing. In particular, the edge of the shade is secured and hidden within the locking structure of the perimeter beam when viewed from the outside edge of the structure.

Additionally, a methodology is provided for installing a shading element the comprises the steps of placing the fabric on a canopy structure, spreading the fabric out over the top of the structure and positioning it in approximate final position, inserting the edge of the shading element into a locking channel in a pivoting perimeter beam, and pivoting the beam around a pivot point to a locking position, thereby pulling the fabric taunt and completing the installation process all in one motion.

The foregoing has outlined some of the more pertinent objects and features of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the Preferred Embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE PREFERRED EMBODIMENT

Figure 1:
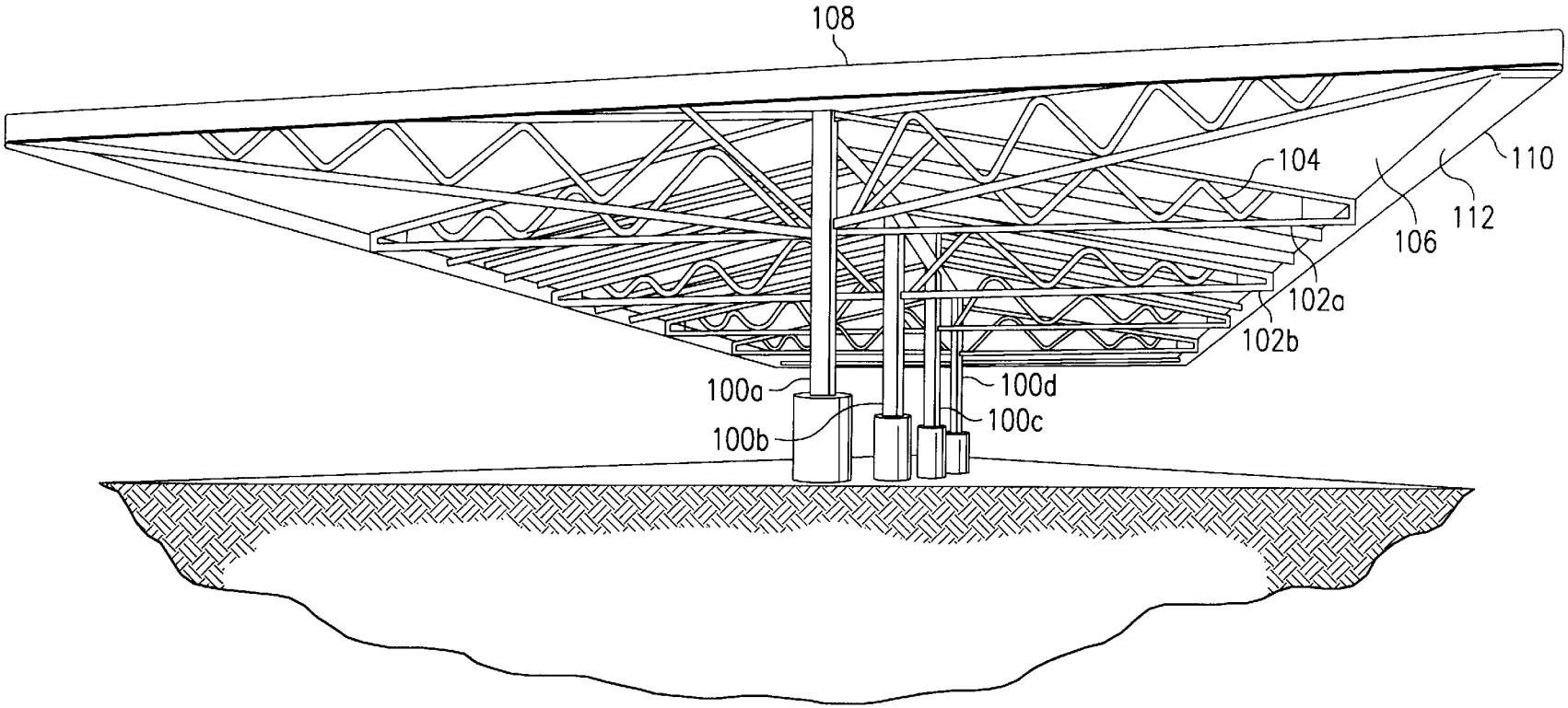
FIG. 1 is a perspective view of a prior art cantilever shade structure.
Figure 2:
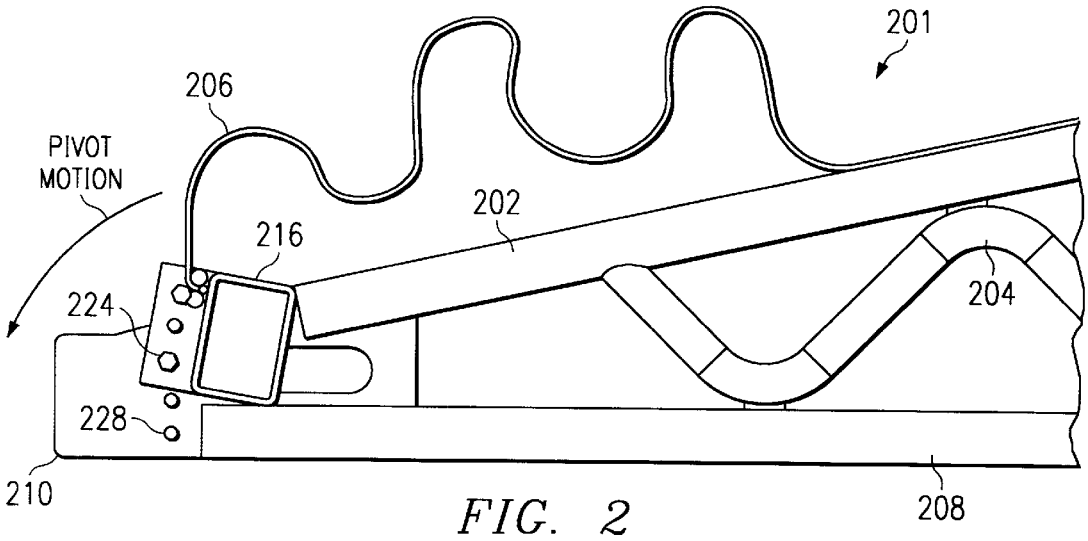
FIG. 2 is an elevation view of an outer portion of an individual truss illustrating the perimeter beam in cross-section in a first, installation position.
Figure 2A:
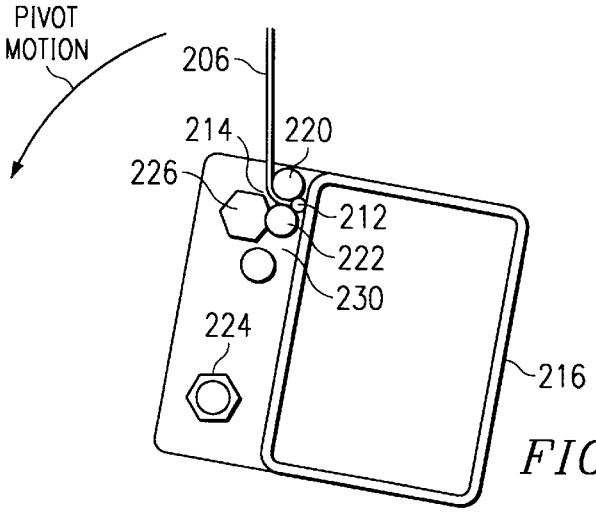
FIG. 2A is a close-up view of the perimeter beam illustrating how the shade fabric end is retained in a locking mechanism of the beam.
Figure 3:
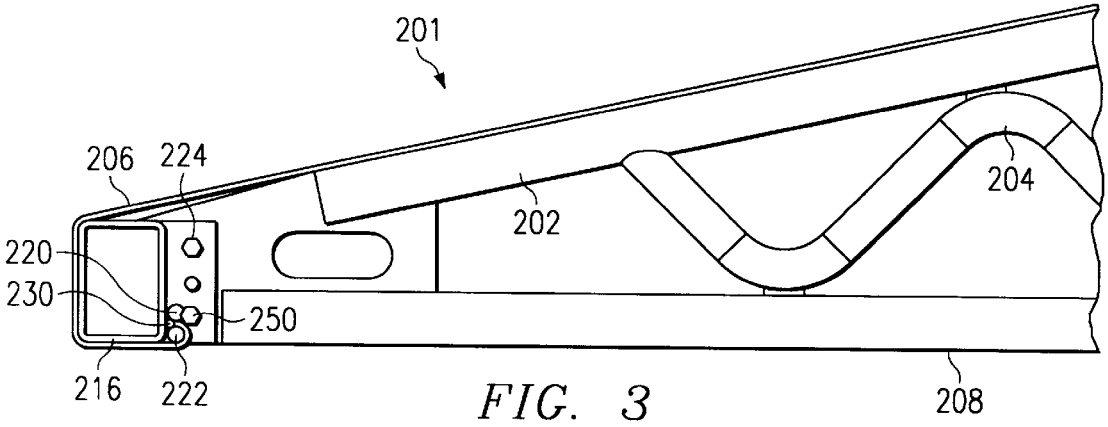
FIG. 3 is an elevation view of the perimeter beam after it has been swiveled into its second, locking position tension and secure the shade.

FIGS. 2, 2A and 3 illustrate the invention in use in a cantilever shade structure. This is not a limitation of the invention, however, as the invention may be used in any structure (regardless of configuration) having a perimeter beam that may be positioned as is now described.

FIG. 2 illustrates a cross-section of a cantilevered shade structure (not shown) consisting of a cantilevered truss section 201. Truss section 201 further comprises of a top truss arm 202, a bottom truss arm 208 joined together at edge 210. Cross support beam 204 may be added to provide additional structural support to the truss section 201. An outer perimeter beam 216 is mechanically attached to edge 210 such that beam 216 may swivel or pivot around a fixed point 224. Beam 216 spans the distance between two separate truss section edges, thereby connecting them.

Various mechanical attachment methods may be utilized as the mechanical pivot point, such as a nut and bolt configuration, a fixed pin configuration or other such means known in the mechanical arts. A shading element such as fabric 206 is placed on top of upper truss arm 202 to provide the shading portion of the structure.

While not meant to be limiting, canopy structure and the truss structure 201 shown in FIGS. 2 and 3 are typically steel structures designed to meet or exceed the requirements of the 1997 Uniform Building Code. All steel tubing is typically triple coated for rust protection using the in-line zinc electroplating process. Tubing is internally coated with zinc and organic coating to prevent corrosion.

While not meant to be limiting, the shading element or fabric 206 typically consists of a high-density polyethylene fabric or some similar material with ultra violet additives. This provides the fabric with a high strength, low shrinkage factor that can withstand wide temperature ranges. Additional properties of the fabric are that it is flexible, abrasion resistant and possesses ultra violet radiation immunity when properly treated. Its properties make it resistant to cleaning agents, acid rain, mildew, rot, chlorine, saltwater, and industrial pollutants. It is constructed using a monofliament and tape construction and Rachel knitted to ensure the fabric will not unravel if cut. Typically, all corners of fabric 206 are strengthened with non-tear vinyl material and a protective webbing is sewn into all areas where steel cable 212 or an alternative rigid material enter and exits the cloth pockets. The rigid material runs the length of the edge of fabric 206

Although not meant to be limiting, steel cable or wire rope 212 is typically ¼ inch nominal diameter, 7 strand, 19 wires per strand, with a nominal tensile strength of 9,000 pounds. Cable 212 is typically secured with approved fittings and hardware.

FIG. 2A illustrates a detailed cross-sectional view of one end of beam 216 in the installation position. In FIG. 2A, fabric 206 is shown with a rigid member, such as steel cable or wire rope 212, placed into an outside pocket 214 along one end of fabric 206. Other such rigid members may be used instead, such as a plastic member, or a metal strip. These can be attached, inserted or sewn into the fabric in the outside pocket 214. Beam 216 further comprises of a fabric-locking mechanism 230 that accepts pocket 214 with cable 212 and restrains it as beam 216 is rotated or pivoted outward and downward into the locked position.

In FIG. 2A, fabric-locking mechanism 230 is comprised of two tubular structures, upper tube 220 and lower tube 222. Tubes 220 and 222 are attached to beam 216 and are parallel to each other and extend the length of beam 216. A gap between tubes 220 and 222 is determined by the thickness of the edge of fabric 206 that contains pocket 214 with cable 212 so that as beam 216 is pivoted outward and downward, pocket 214 with cable 212 is "caught" within the locking mechanism's 230 gap and locked into it.

Figure 5A:
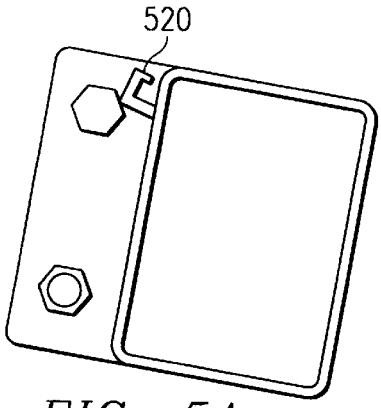
FIGS. 5A–5E are close-up views of various perimeter beams illustrating how the shade fabric end is retained in various different locking mechanisms of the design.
Figure 5B:
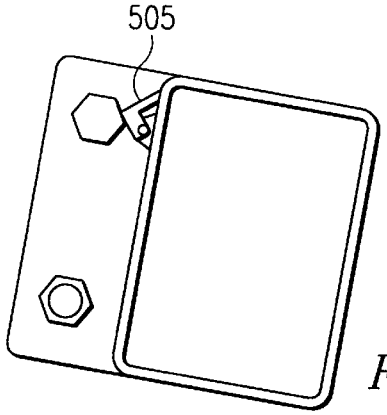
Figure 5C:
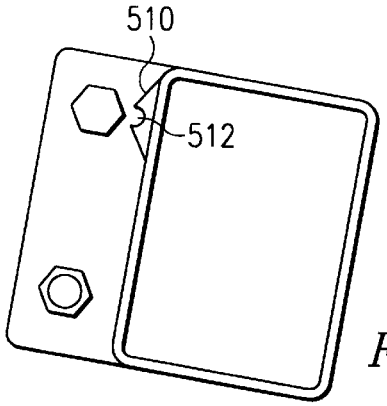
Figure 5D:
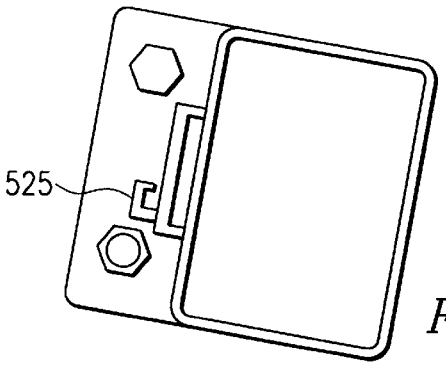
Figure 5E:
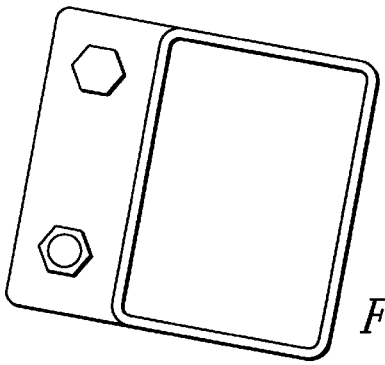

Fabric locking mechanism 230 may be designed differently to facilitate the invention and the present discussion is not meant to be limiting. FIGS. 5A–D illustrate different examples of potential locking mechanisms 230. FIG. 5A shows "lip" structure 520 whereby the cable is positioned below lip 530 and as beam is rotated into position lip 520 secures pocket 214. FIG. 5B shows clamping structure 505 that secures the fabric to beam 216. FIG. 5C shows male/female coupling means 510, whereby fabric pocket 214 is inserted into the receiving portion 512 of beam 216. FIG. 5D shows movable and adjustable locking means 525, whereby as beam 216 is rotated an inner portion covers and secures pocket 214 with the portion of beam 216.

When beam 216 is in the installation position as shown in FIGS. 2 and 2A, fabric 206 with cable 214 may be inserted between tubes 220 and 222 or inserted into any of the other locking mechanisms as above described.

FIG. 2A further illustrates beam 216 comprising of a second hole 226 for a second attaching means that is used to secure beam 216 to end 210 when beam 216 is in the locked position. In FIGS. 2 and 2A, beam 216 is shown in the installation position, and thus hole 226 is devoid of an attaching means such as a nut and bolt. When the present invention is pivoted into the "locked" position, as described below in FIG. 3, a nut and bolt or similar mechanical securing device will be inserted through hole 226 such that the lower portion of beam 216 is attached or locked to lower truss arm 208 at edge 210.

FIG. 3 illustrates the present invention in the "locked" position. In FIG. 3, beam 216 has been rotated outward and downward about pivot hole 224 until hole 226 is lined up with hole 228, providing a passage through which an attachment means may be inserted through both holes. By inserting the attachment means such as a nut and bolt configuration through holes 226 and 228 and tightened the nut and bolt configuration, beam 216 is secured to edge 210 such that no further pivoting may occur. Additionally, the attachment means in pivot hole 224 is tightened or secured such that beam 216 is rigidly attached to edge 210 through both points 224 and 228. When beam 216 is in the "locked", fabric 206 is pulled taunt. Cable 212 is "locked" into position between locking mechanism 230 by the tension on fabric 206, the tension being provided by the fabric being presented on increased surface area of beam 216 upon the rotation of beam 216 around pivot 224 and "locked" into position.

Figure 4:
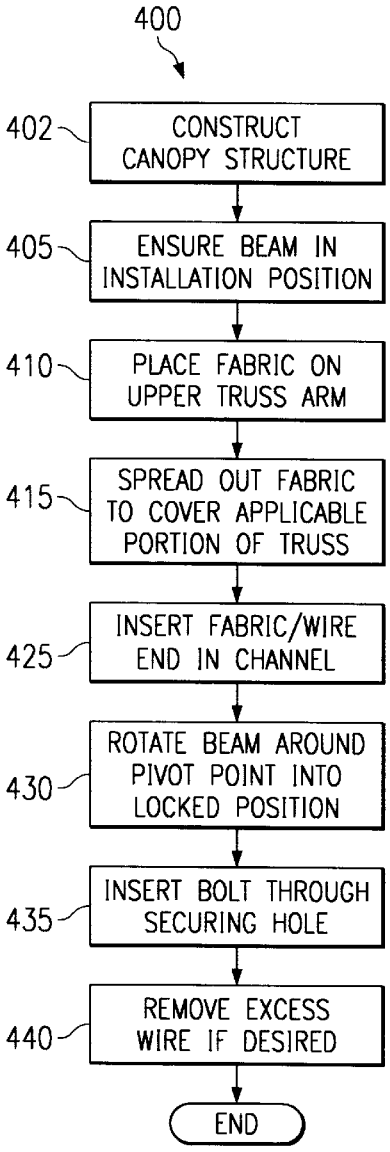
FIG. 4 is an illustration methodology for the present invention in block diagram form.

FIG. 4 illustrates in block the present inventive methodology 400 from the installation position to locking position. In step 402, a canopy structure is assembled to receive fabric 206. Beam 216 is placed in the "installation position" in step 405. In step 410, fabric 206 is positioned on top of the upper truss in the approximate layout designed for the canopy-shading portion. Once approximately positioned, fabric 206 is elongated and loosely positioned over the upper truss arm 202 in step 415 to cover the desired portion of upper truss arm 202. In this step, fabric 206 is not pulled taunt.

Once the fabric covers the desired portion of upper truss arm 202, the end of fabric 206 with pocket 214 and cable 212 is inserted into locking mechanism 230, which in the present example comprises of placing pocket 214 in between tubes 220 and 222, coupling the length of the edge of fabric 206 with beam 216 in step 425. Once successfully inserted in between the locking tubes, beam 216 is rotated outward and downward around pivot point 224 in step 430.

While in rotation, the end of fabric 206 with cable 212 remains in between locking mechanism 230. The rotation of beam 216 wraps the end portion of fabric 206 around the outer portion of beam 216 increasing the effective surface area that fabric 206 covers. As step 430 occurs, beam 206 begins to pull fabric 206 taunt, and pocket 214 with cable 212 is locked into place by locking mechanism 230 through the tension produced on fabric 206 caused by the increased surface area that fabric 206 is exposed to.

Once upper hole 226 is aligned with hole 228 on edge 210, beam 216 is in the "locked" position. An attachment means such as a nut and bolt is inserted through holes 226 and 228 to secure beam 216 in the locked position in step 435. Finally, once beam 216 is locked into place, pivot bolt 224 is secured and any extraneous wire 212 may be removed to ensure a smooth and ascetically pleasing appearance in step 440.

The present invention provides numerous advantages. Assembling the structure with the present invention provides a system and methodology for ensuring a uniform and consistent position for the shading fabric over the canopy structure. Using the present invention, the canopy is tightened to the correct specifications the first time, providing a uniform, taunt, secure fit over the length of the canopy structure. The uniform fit ensures an ascetically pleasing appearance for the structure, proper shading protection, and structural support due to decreased wind resistance.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

Having described the invention, what is now claimed is:

1. In a shade structure having a shading element, at least a pair of support posts each of which support at least one outwardly-extending truss, and a perimeter beam that extends between two or more trusses, the improvement comprising:

a fastener for securing the perimeter beam for pivotal movement between a first, installation position and a second, locking position; and a channel extending along a length of the perimeter beam for receiving an edge of the shading element such that when the perimeter beam is pivoted about the fastener from the first, installation position to the second, locking position the shading element edge is tensioned.

2. The shade structure of claim 1 further comprising of a second fastener for securing the perimeter beam into the locking position such that when the perimeter beam is pivoted into the locking position, the second fastener is inserted through a receiving hole in the perimeter beam and the truss.

3. The Shade structure of claim 1 wherein the edge of the shading element further comprises of a rigid member sewn into a pocket at the edge of the shade.

4. The Shade structure of claim 1 wherein the shading element further comprises of high density polyethylene.

5. The Shade structure of claim 1 wherein the shading element further comprises of an ultra violet coating.

6. A method of erecting a shading element on a structure having the shading element, at least a pair of support posts each of which support at least one outwardly-extending truss, and a perimeter beam that extends between two or more trusses, the steps comprising of:

spreading the shading element over the top of the trusses in the approximate final position;

inserting an edge of the shading element into a channel extending along a length of the perimeter beam; and pivoting the perimeter beam about a fastener, the perimeter beam pivoting from a first installation position to a second locking position.

7. The method in claim 6 wherein the step of pivoting the perimeter beam further comprises the step of pivoting the perimeter beam less than one complete rotation into the locking position.

8. The method described in claim 6 further comprising the steps of:

sewing a rigid member into the edge of the shading element; and receiving the rigid member into the channel of the perimeter beam when the edge of the shading element is inserted into the channel.

9. The method described in claim 6 further comprising the steps of locking the perimeter beam by inserting a mechanical attachment means into a hole between the perimeter beam and the truss.

* * * * *